US010634340B2

(12) United States Patent
Agar et al.

(10) Patent No.: US 10,634,340 B2
(45) Date of Patent: Apr. 28, 2020

(54) DUAL CHAMBER SYSTEM AND METHOD TO GENERATE STEAM FOR CALIBRATION

(71) Applicant: AGAR CORPORATION Ltd., Grand Cayman (KY)

(72) Inventors: Joram Agar, Grand Cayman (KY); David Farchy, Bellaire, TX (US)

(73) Assignee: Agar Corporation Ltd., Grand Cayman (KY)

( * ) Notice: Subject to any disclaimer, the term of this patent is extended or adjusted under 35 U.S.C. 154(b) by 1219 days.

(21) Appl. No.: 14/923,813

(22) Filed: Oct. 27, 2015

(65) Prior Publication Data

US 2016/0116157 A1 Apr. 28, 2016

Related U.S. Application Data

(60) Provisional application No. 62/069,220, filed on Oct. 27, 2014.

(51) Int. Cl.
*F22B 1/28* (2006.01)

(52) U.S. Cl.
CPC ..... *F22B 1/28* (2013.01)

(58) Field of Classification Search
CPC ..... F22B 1/28; F22D 5/26
USPC ..... 122/448.3
See application file for complete search history.

(56) References Cited

U.S. PATENT DOCUMENTS 1,930,455 A * 10/1933 Hannum ..... F22B 37/42 122/459
1,930,456 A * 10/1933 Rumble ..... F22B 37/42 122/479.1
2,427,150 A * 9/1947 McCann ..... F24H 1/225 392/461
4,576,124 A * 3/1986 Martens ..... F01K 23/108 122/406.5
4,637,349 A * 1/1987 Robinson ..... F24D 12/02 122/448.3
7,387,090 B2 * 6/2008 Russoniello ..... F22B 1/02 122/406.1

(Continued)

OTHER PUBLICATIONS

Hussein, I. B. and I. Owen, "Calibration of flowmeters in superheated and wet steam", Flow Measurement and Instrumentation, vol. 2, Oct. 1991, pp. 209-215.

(Continued)

*Primary Examiner* — Daniel S Larkin
(74) *Attorney, Agent, or Firm* — Craft Chu PLLC; Andrew W. Chu

(57) ABSTRACT

The dual chamber system has a source chamber and a receiver chamber. The source chamber generates a first steam in a first steam section, and the receiver chamber generates a second steam in a second steam section. The first steam is at a higher temperature than the second steam, and the first steam is at 100% quality. The first steam is injected into a mixing section of the receiver chamber to generate a condensed steam. A sensor or instrument can then be calibrated by the condensed steam. The measurement being taken with the sensor or instrument will have reliability and accuracy. The method includes generating the first steam, generating the second steam, injecting and mixing the first and second steam to form condensed steam at a metering point in the receiver chamber, and calibrating a sensor or instrument at the metering point.

10 Claims, 1 Drawing Sheet

(56) References Cited

U.S. PATENT DOCUMENTS

2006/0065213 A1* 3/2006 Sarkar ..... F22B 31/00
122/406.1
2013/0161009 A1* 6/2013 Price ..... E21B 43/2406
166/303

OTHER PUBLICATIONS

Ishibashi, M., T. Funaki, and M. Takamoto, "Wet Steam Flowrate Calibration Facility" ASME-JSME-KSME 2011 Joint Fluids Engineering Conference, Hamamatsu, Shizuoka, Japan, Jul. 2011.

* cited by examiner

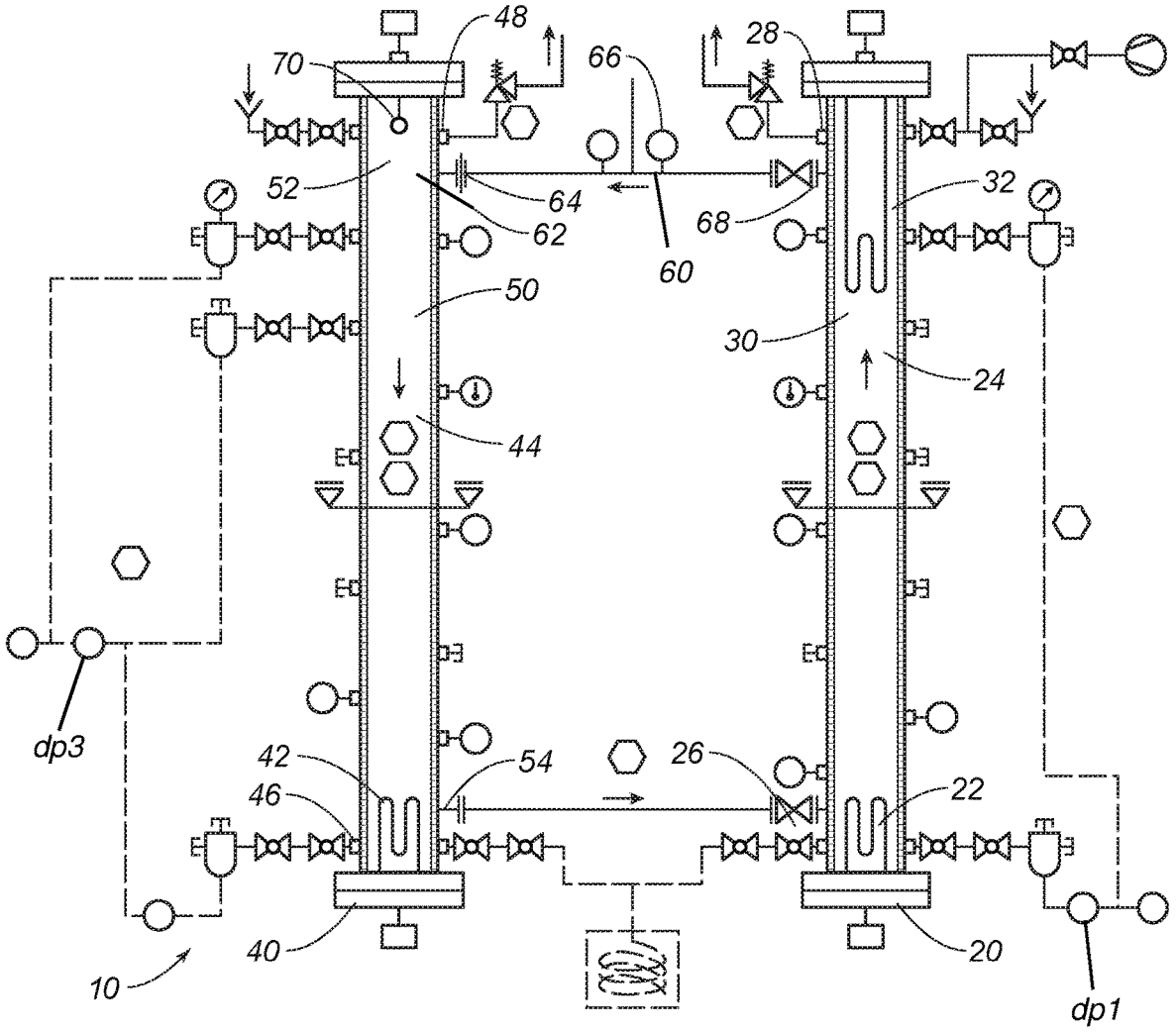
48
70
66
28
52
64
62
68
32
60
50
30
24
44
dp3
42
54
26
46
22
40
20
10
dp1

DUAL CHAMBER SYSTEM AND METHOD TO GENERATE STEAM FOR CALIBRATION

CROSS-REFERENCE TO RELATED APPLICATIONS

The present application claims priority under 35 U.S.C. Section 119(e) from U.S. Provisional Patent Application Ser. No. 62/069,220, filed on 27 Oct. 2014, entitled "DUAL CHAMBER SYSTEM AND METHOD FOR CALIBRATION WITH STEAM".

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a dual chamber system and method to calibrate sensors and devices. In particular, the present invention relates to generating quality steam for calibrating a sensor. More particularly, the present invention relates to a dual chamber system to determine known parameters of steam at a location, where a device is to be calibrated at the location.

2. Description of Related Art Including Information Disclosed Under 37 CFR 1.97 and 37 CFR 1.98

There are many technologies in the oil and gas industry to increasing the amount of oil extracted from an oil field. More efficient extraction results in less waste and greater yield. With new technology, previously spent oil fields or even low producing oil fields can be reinvigorated for new production or extended production. Enhanced Oil Recovery (EOR) includes those techniques for increasing or improving the extraction of oil from an oil field.

Generally, the methods for enhanced oil recovery include heating the hydrocarbons, including crude oil, bitumen, and liquid natural gas, in the ground formation to lower viscosity for easier pumping. Additional heat reduces surface tension and increases permeability. For some EOR, the hydrocarbons are vaporized, which also facilitates the extraction from the formation. Vaporized oil can be condensed later for a cleaner hydrocarbon with fewer impurities.

Examples of EOR techniques include steam flooding or steam injection and steam assisted gravity drainage. Steam injection involves cyclically pumping steam into a well. The steam condenses to hot water, which heats the oil or evaporates the oil. The hotter oil has less viscosity and pumps easier for extraction. The evaporated oil can be collected and condensed into a cleaner oil composition later. Steam injection can be applied to relatively shallow wells and relatively dirty hydrocarbons, such as heavy crude oil and bitumen. Steam Assisted Gravity Drainage (SAGD) is a more complex utilization of steam to recover more hydrocarbons. In SAGD, two horizontal wells are drilled into an oil reservoir, without one horizontal well above the other horizontal well. High pressure steam is injected through the upper horizontal well, and the more fluid oil drains into the lower horizontal well for extraction. SAGD is used for even tougher and dirtier heavy crude oils and oil sands.

There are existing means of producing steam for enhanced oil recovery techniques, including steam boilers and steam calibration loops. Steam boilers are well known as being a heated vessel capable of boiling water, often at high pressure and thus increased temperature. Steam calibration loops are also used to provide steam for other applications. Determining the properties of the steam generated is important for managing and controlling the EOR process. The steam generated is measured by instruments during EOR processes.

There is a need to calibrate these instruments for sensing and detecting steam. For example, one instrument is a flow meter. The flow meter for wet steam can be calibrated, as disclosed in the article by Hussein et al. [Flow Meas. Instrum., Vol. 2, October, 1991, p. 209-215]. In the experimental apparatus the saturated steam is superheated in a superheater. To generate wet steam, water is injected into the superheated steam via a set of fine sprays. From the knowledge of the water and total steam flow rates, and the temperatures and pressures of the superheated steam and the water, an energy balance can be used to calculate the final steam dryness fraction. The wet steam flow loop was metrologically certified and was used to calibrate different wet steam flow meters. The wet steam correction factors were determined for several industrial steam flow meters.

The system for accurate measurement of steam flow rate, dryness fraction, i.e. steam quality factors, was disclosed in the article by Hussein et al. [Flow Meas. Instrum., Vol. 3, No. 4, 1992, p. 235-240]. The system consists of a separator and condensate flowmeter followed by a steam flowmeter. Testing of the energy metering system showed that the average differences between the displayed output of the system and the values obtained using a condensate weight tank was about 0.22% for the dryness fraction and 1.05% for the saturated steam flow rate.

Another wet steam flowrate calibration facility is disclosed by Ishibashi et al. [Proceedings of the ASME-JSME-KSME Joint Fluids Engineering Conference, Jul. 24-29, 2011, Hamamatsu, Shizuoka, Japan, 2011, p. 1-6]. The facility has a closed loop in which boilers generate a steam flow up to 800 kg/h. Steam can be generated at a pressure up to 1.6 MPa. The saturated steam generated by two boilers in the loop is super-heated by a heater, then a cooling system controls the wetness, which is calculated from the enthalpy drawn from the superheated steam using the temperature difference and water flowrate in the cooling system. After passing the calibration line, the wet steam is totally cooled down into the water phase then the water flowrate is measured by a Coriolis flowmeter kept at the ambient temperature. All the dominating measuring instruments were calibrated and traceable to the national standards. The facility can measure the total flowrate with error of 0.57% and the steam [gaseous] flowrate with error 0.61%, while steam dryness fraction error is 0.10%.

Generally, prior art calibrated wet steam generators use a flow loop structure. The steam quality is changed either by mixing the superheated steam with water, or by cooling the superheated steam to a predetermined temperature.

It is an object of the present invention to provide an embodiment of a system to calibrate instruments measuring the steam from a steam boiler or steam calibration loop.

It is an object of the present invention to provide an embodiment of a system to calibrate instruments for measuring steam with steam.

It is an object of the present invention to provide an embodiment of a dual chamber system to calibrate instruments for measuring steam.

It is an object of the present invention to provide an embodiment of a dual chamber system to generate a condensed steam with a known quality to calibrate instruments for measuring steam.

It is another object of the present invention to provide an embodiment of a method of generating a condensed steam with a known quality to calibrate instruments for measuring steam.

These and other objectives and advantages of the present invention will become apparent from a reading of the attached specification.

BRIEF SUMMARY OF THE INVENTION

Embodiments of the present invention include a dual chamber system for calibrating sensors and instruments. The dual chamber has a source chamber and a receiver chamber. The source chamber has a first heating element, a first steam section, first inlet, and first outlet. The source chamber generates a first steam at a first temperature in the first steam section. The receiver chamber has a second heating element, a second steam section, a second inlet, and a second outlet. The receiver chamber generates a second steam at a second temperature in the second steam section. The second steam section is comprised of a mixing section. The first temperature is greater than the second temperature.

In some embodiments, the source chamber and the receiver chamber are insulated and heat traced. Also, the source chamber can have an additional heating element at a top of the first steam section. The source chamber and the receiver chamber can maintain heat for condensation constancy, minimizing heat loss due to condensation. For the source chamber, the first steam can have steam quality of 100% and is maintained with a steam quality of 100%. In other embodiments, the receiver chamber has a fluid outlet in fluid connection with the first inlet of the source chamber. Water can recycle back from the fluid outlet of the receiver chamber to the first inlet of source chamber.

The present invention further comprises an injection means between the first steam section and the second steam section, and in particular, the injection means is in a mixing section of the second steam section. The injection means can be comprised of a connecting pipe and a flow meter or any prior art structure for injecting steam. Other parts of the injection means may include an expansion nozzle, and any number of valves. In the embodiment with the flow meter, flow rate of the first steam into the mixing section can be measured.

In the mixing section, the first steam mixes with the second steam so as to form a condensed steam. The first steam, second steam, and condensed steam have known or measurable parameters comprised of at least one of a group consisting of: liquid height level of the source chamber, pressure of the source chamber, density by differential pressure of the source chamber, cloud density by differential pressure of the source chamber, temperature of the source chamber, energy input into the source chamber, liquid height level of the receiver chamber, pressure of the receiver chamber, density by differential pressure of the receiver chamber, cloud density by differential pressure of the receiver chamber, temperature of the receiver chamber, and energy input into the receiver chamber. In some embodiments with a flow meter in the injection means, the flow rate into the mixing section determines a known parameter of the condensed steam.

With a set value of steam quality in the mixing section, the system includes a metering point in the mixing section of the receiver chamber. The metering point is exposed to the condensed steam so that any sensor or instrument engaged to the metering point can detect the condensed steam. The sensor or instrument is calibrated to the set value of steam quality or other known parameters of the condensed steam. The metering point can be at a top of the receiver chamber or at least near injection means, such as near the expansion nozzle of the injection means.

Embodiments of the method for calibrating comprise the steps of generating a first steam at a first temperature in a first steam section of a source chamber; generating a second steam at a second temperature in a second steam section of a receiver chamber with the first temperature being greater than the second temperature; injecting the first steam from the first steam section into the mixing section so as to form a condensed steam; and exposing a metering point to the condensed steam. Engaging a sensor or instrument to the metering point allows the sensor or instrument to detect the condensed steam for calibration. The condensed steam generated at the metering point has a set value of steam quality or other known parameter to calibrate sensors and instrument at the metering point.

The method of the present invention can also include embodiments with the steps of confirming the set value of steam quality in the mixing section of the receiver chamber. The step of confirming is comprised of determining a first value of steam quality in the mixing section of the receiver chamber by measuring steam density in the mixing section of the receiver chamber and determining a second value of steam quality in the mixing section of the receiver chamber by measuring energy balance and liquid accumulation in the receiver chamber. Then, at least one parameter of the first steam and the second steam can be adjusted until the first value of steam quality confirms the second value of steam quality so as to determine the set value of steam quality as the metering point. Confirming can include matching the first value of steam quality and the second value of steam quality, or the first value of steam quality and the second value of steam quality being within an acceptable amount of variation to determine the set value of steam quality. In some embodiments, step of confirming the liquid accumulation includes establishing a set value of mass of steam leaving the source chamber. The first and second steam can also be adjusted until a first value of mass of steam leaving the source chamber confirms a second value of mass of steam leaving the source chamber. The set value of mass of steam by different measurements and equations of the first value and the second value of mass of steam leaving the source chamber is confirmed by different measurements and equations for more reliability.

BRIEF DESCRIPTION OF THE SEVERAL VIEWS OF THE DRAWINGS

FIG. 1 is a schematic view of an embodiment of a dual chamber system for calibrating with steam of the present invention.

DETAILED DESCRIPTION OF THE INVENTION

Referring to FIG. 1, the present invention is the system 10 for calibrating sensors and instruments with generated steam. When utilizing steam generation in industrial processes, such as enhanced oil recovery, the steam must be monitored and regulated for effectiveness. For enhanced oil recovery, the injection of steam affects the efficiency of extracting hydrocarbons. Detecting the properties of that steam allows for improved control and regulation of the enhanced oil recovery process. The system 10 of the present invention calibrates the sensors and instruments to be used in measuring the steam in enhanced oil recovery processes. The sensors and instruments assess steam generated for the EOR process, such as steam to be injected into the formation.

Embodiments of the present invention include the system 10 as a dual chamber system with a source chamber 20 and a receiver chamber 40. The source chamber 20 has a first heating element 22, a first steam section 24, first inlet 26, and first outlet 28. The source chamber 20 generates a first steam 30 at a first temperature in the first steam section 24. The first inlet 26 is in fluid connection with a fluid source, such as water, which is heated to produce the first steam 30. The first outlet 28 releases to the atmosphere so that the first steam 30 can be maintained under certain conditions. The first heating element 22 is positioned at the bottom of the source chamber 20 for contacting the water to be heated into the first steam 30. In some embodiments, the source chamber 30 has an additional heating element 32 at the top of the first steam section 24 in order to maintain the heat of the first steam 30. Heat loss due to condensation can be adjusted with the additional heating element 32. In some embodiments, the first steam 30 has steam quality of 100%. The first steam 30 is fully saturated; it is ready to condensate, if conditions change. The source chamber 20 can also be insulated and heat traced to reduce heat loss and maintain the first steam at 100% steam quality.

FIG. 1 shows the receiver chamber 40 having a second heating element 42, a second steam section 44, a second inlet 46, and a second outlet 48. The receiver chamber 40 generates a second steam 50 at a second temperature in the second steam section 44. FIG. 1 also shows the second steam section 44 comprised of a mixing section 52 at a top of the second steam section 44. The first temperature is greater than the second temperature. The second inlet 46 is in fluid connection with a fluid source, such as water, which is heated to produce the second steam 50. The first outlet 48 releases to the atmosphere so that the second steam 50 can be maintained under certain conditions. The second heating element 42 is positioned at the bottom of the receiver chamber 40 for contacting the water to be heated into the second steam 50. The receiver chamber 40 can have a fluid outlet 54 in fluid connection with the first inlet 26 of the source chamber 20. Water recycles back from the fluid outlet 54 of the receiver chamber 40 to the source chamber 20. The receiver chamber 40 can also be insulated and heat traced to reduce heat loss and maintain conditions of the receiver chamber 40.

There is an injection means 60 between the first steam section 24 and the mixing section 52. The first steam 30 mixes with the second steam 50 in the mixing section 52 so as to form a condensed steam 62 with known parameters. The injection means 60 can be comprised of a connecting pipe and a flow meter or any prior art structure for injecting steam. FIG. 1 shows a schematic view of an injection means 60 with an expansion nozzle 64, flow meter 66 and any number of valves 68. In the embodiment with the flow meter 66, flow rate of the first steam 30 into the mixing section 52 can be measured. The flow rate can also determine a known parameter of the condensed steam 62.

In one embodiment, the source chamber 20 is a boiler to generate steam at 100% quality at an elevated temperature, such as 350 C. The receiver chamber 40 receives the steam coming from the boiler via a top pipe, and condensation occurs because the steam in the receiver chamber 40 was only at 300 C. During this natural condensation, caused by pressure and temperature drop, a fine cloud of wet steam will be developing in the top chamber of the receiver as the condensed steam 62. The steam cloud is in an ideal condition to test and calibrate the sensor or instrument located on the top of the receiver. The sensor and instrument can be used later in another process to measure steam quality.

FIG. 1 shows the first steam 30 mixing with the second steam 50 in the mixing section 52 so as to form a condensed steam 62. The first steam, second steam, and condensed steam have known or measurable parameters comprised of at least one of a group consisting of: liquid height level of the source chamber 20, pressure of the source chamber 20, density by differential pressure of the source chamber 20, cloud density by differential pressure of the source chamber 20, temperature of the source chamber 20, energy input into the source chamber 20, liquid height level of the receiver chamber 40, pressure of the receiver chamber 40, density by differential pressure of the receiver chamber 40, cloud density by differential pressure of the receiver chamber 40, temperature of the receiver chamber 40, and energy input into the receiver chamber 40. Sensing devices and detectors on the source chamber 20 and receiver chamber 40 collect this data for determining the known parameters. In the embodiments with a flow meter 66 in the injection means 60, the flow rate into the mixing section 52 can also determine a known parameter of the condensed steam 62.

The system and method of the present invention involve parameters of the condensed steam 62, which can be known, measured or calculated by measuring other parameters, such as how much steam is generated in the boiler or source chamber 20 and transferred to the receiver or receiver chamber 40. The system and method utilize the following equations for the relationships between the first steam, the second steam, and the condensed steam. A first value through a first set of measurements, variables and equations is determined. A second value through a second set of measurements, variables, and equations is determined. The first value should confirm the second value, even through a different methodology and calculation. Confirming means that the comparison of the first value and the second value is a match or at least within an acceptable amount. The adjustments to the first steam and the second steam can be made until the first value confirms the second value so as to determine the set value. The set value is now more reliable as established by different variables and measurements for equations, while reaching the same confirmed set value. In the present invention, an embodiment is steam quality in the mixing section, wherein steam quality in the mixing section needs a set value. The set value of steam quality can be so reliable and confirmed so that other sensors and instruments can be calibrated to the condensed steam. These equations can be experimentally modified to account for sources of error such as liquid accumulation on the chamber walls. A first method is to measure the water level in the boiler using differential pressure transmitter dp1; the rate of the level reduction is proportional to the mass of steam leaving the boiler:

$$\dot{M}_{sb}=\rho_{lb}A_p dh_b/dt. \quad \text{(Equation 1)}$$

The second method is to measure the power supplied to the main heater to sustain the boiling condition and the fixed set point of 350 C. The power is equal to the enthalpy of the steam in the boiler which at a fix set point is also linearly proportion to the mass flow rate:

$$\dot{M}_{sb}=P_b/U_{lgb}. \quad \text{(Equation 2)}$$

There are also two methods to know the steam quality in the top of the receiver chamber. The first method is to measure the density of the steam at the top chamber using dp3:

$$\rho_r = dp_3/gh_3 = \frac{1}{(1-x_{rg})/\rho_{lr} + x_{rg}/\rho_{gr}} \quad \text{(Equation 3)}$$

With $\rho_{lr}$ and $\rho_{gr}$ known from the temperature and pressure measurements, while g is a constant, $h_3$ comes from the design dimensions, and $dp_3$ is directly measured. Solving for $x_{rg}$ using only these quantities:

$$x_{rg} = \frac{\rho_{gr}(g\rho_{lr} - dp_3 h_3)}{dp_3 h_3(\rho_{lr} - \rho_{gr})} \quad \text{(Equation 4)}$$

The second method is by energy balance and liquid accumulation in the bottom of the receiver.

$$\dot{M}_{sb}H_{sb}=\dot{M}_{gr}U_{gr}+\dot{M}_{lr}U_{lr}+Q \quad \text{(Equation 5)}$$

In Equation 5, Q is measured by the reduction of heat from the initial heat supply to keep pressure and temperature. Note that $\dot{M}_{gr}$ is only the steam-gas sourced from the boiler, not the total steam-gas. When going from the boiler to the receiver, one can assume $\dot{M}_{gr}$ is zero, as in fact the volume reduction in the receiver due to water formation causes some of the $\dot{M}_{gi}$ or initial gaseous-steam mass to condense.

$$\dot{M}_{sb}=\dot{M}_{gr}+\dot{M}_{lr}=\dot{M}_{lr} \quad \text{(Equation 6)}$$

Combine Equations 5 and 6:

$$\dot{M}_{lr} = \frac{\dot{M}_{sb}H_{sb} - Q}{U_{lr}} = \frac{P_b/U_{lgb} - Q}{U_{gr} - U_{lr}} \quad \text{(Equation 7)}$$

It is assumed that the combined condensate mass in the cloud is greater than that condensing from $\dot{M}_{gi}$, so the excess condensing due to volume reduction displaces to increase $\dot{M}_{lrw}$, or water-column mass.

$$V_r=V_{fg}+V_{lB}+V_{lrc} \quad \text{(Equation 8)}$$

$$\dot{M}_{tot}=\dot{M}_{gi}+\dot{M}_{lr}=\dot{M}_{gf}+\dot{M}_{lr}+\dot{M}_{gil} \quad \text{(Equation 9)}$$

$$V_{lB}=\dot{M}_{sb}/\rho_{lr} \quad \text{(Equation 10)}$$

Combining Equations 8 and 9 and substituting Equation 10 shows that:

$$V_{fg} = V_r - \frac{\dot{M}_{sb}}{\rho_{lr} - \rho_{gr}} \quad \text{(Equation 11)}$$

$$V_{lrc} = \left(\frac{\dot{M}_{sb}}{\rho_{lr} - \rho_{gr}}\right)\cdot\left(\frac{\rho_{gr}}{\rho_{lr}}\right) \quad \text{(Equation 12)}$$

$$\dot{M}_{gf} = \dot{M}_{gi} - \dot{M}_{gil} = V_r\rho_{gr} - \dot{M}_{gil} \quad \text{(Equation 13)}$$

$$\dot{M}_{gil} = V_{lrc}\rho_{lr} = \frac{\rho_{gr}\dot{M}_{sb}}{\rho_{lr} - \rho_{gr}} \quad \text{(Equation 14)}$$

$$\dot{M}_{gf} = \rho_{gr}\left(V_r - \frac{\dot{M}_{sb}}{\rho_{lr} - \rho_{gr}}\right) \quad \text{(Equation 15)}$$

$$\dot{M}_{lrw} = \Delta h_r A_p \rho_{lr} - \frac{\rho_{gr}\dot{M}_{sb}}{\rho_{lr} - \rho_{gr}} \quad \text{(Equation 16)}$$

$$x_{rg} = \frac{\dot{M}_{gf}}{\dot{M}_{gf} + \dot{M}_{sb} - \dot{M}_{lrw}} \quad \text{(Equation 17)}$$

$$x_{rg} = \frac{\rho_{gr}\left(V_r - \frac{\dot{M}_{sb}}{\rho_{lr} - \rho_{gr}}\right)}{\rho_{gr}V_r + \dot{M}_{sb} - \Delta h_r A_p \rho_{lr}} \quad \text{(Equation 18)}$$

Compare Equation 18, which is $x_{rg}$ calculated via added mass from the boiler source and known or measured quantities, and Equation 4 calculated via steam density for two different methods to measure $x_{rg}$ and evaluate error.

Apart from mixing inside the receiver, it is possible to evaluate the steam immediately after the expansion valve. This can be done using one of two different assumptions, either that the enthalpy (h) remains constant, or that the entropy (s) remains constant. These assumptions produce different expectations for the resulting steam quality; for example, using the enthalpy condition for 350 C and 300 C results in an expected steam quality of 86.8% while the constant entropy condition yields an expected steam quality of 79.9%. Real behavior is likely to be somewhere in between. Equation 19 is the constant enthalpy condition, while Equation 20 is the constant entropy condition.

$$x_{evH} = \frac{H_{sb} - H_{wev}}{H_{sev} - H_{wev}} \quad \text{(Equation 19)}$$

$$x_{evS} = \frac{S_{sb} - S_{wev}}{S_{sev} - S_{wev}} \quad \text{(Equation 20)}$$

In case the process is adiabatic as suggested in equation 19 for an adiabatic process, the X measured in the tank after time period T will be according to the below equation $$M_{lr0}h_{lr0} + M_{gr0}h_{gr0} + \dot{M}_{sb}h_{Sb}T = M_{lr1}h_{lr1} + M_{gr1}h_{gr1} \quad \text{(Equation 21)}$$

$$M_{lr0} + M_{gr0} + \Delta\dot{M}_{sb} = M_{lr1} + M_{gr1} \quad \text{(Equation 22)}$$

$$M_{gr1} = \frac{M_{lr0}h_{lr0} + M_{lg0}h_{lg0} + \Delta\dot{M}_{lg0}h_{Sb} - (M_{lr0} + M_{gr0} + \Delta\dot{M}_{sb})h_{lr1}}{h_{gr1} - h_{lr1}} \quad \text{(Equation 23)}$$

$$X_1 = \frac{M_{lr0}h_{lr0} + M_{lg0}h_{lg0} + \Delta\dot{M}_{lg0}h_{Sb} - (M_{lr0} + M_{gr0} + \Delta\dot{M}_{sb})h_{lr1}}{(h_{gr1} - h_{lr1})(M_{lr0} + M_{gr0} + \Delta\dot{M}_{sb})} \quad \text{(Equation 24)}$$

Where:

$\dot{M}_{sb}$—Steam mass generated in boiler source $\dot{M}_{gr}$—Gas mass in the receiver left after condensation due to injection from the boiler source $\dot{M}_{lr}$—Liquid mass in the receiver left after condensation from the boiler source, in or out of the cloud $\dot{M}_{gi}$—Gas mass in the receiver from the initial receiver state $\dot{M}_{gil}$—Gas mass in the receiver which condenses to liquid due to volume reduction from boiler injection.

$\dot{M}_{gf}$—Gas mass in the receiver from the final receiver state $\dot{M}_{lrw}$—Liquid mass in the receiver existing as part of the water-pool due to the boiler source Pb—Heating Power to generate steam in the boiler Q—Heat removed from the receiver $U_{lgb}$—Latent Internal Heat at the boiler condition $U_{gr}$—Gas Internal Heat at the receiver condition (per unit mass)

$U_{lr}$—Water Internal Heat at the receiver condition (per unit mass)

$H_{sb}$—Steam enthalpy at the boiler condition (per unit mass)

$V_{rg}$—Gas chamber volume at the receiver $V_r$—Volume of the receiver $V_{fg}$—Final gas volume $V_{lB}$—Liquid volume from the boiler $V_{lrc}$—Liquid volume from receiver steam condensing due to decreased available volume $\rho_r$—Density of the receiver gas chamber steam $\rho_{gr}$—Density of the gas at the receiver condition $\rho_{lr}$—Density of the Liquid at the receiver condition $\rho_{lb}$—Density of the Liquid at the boiler condition $dp_3$—Differential Pressure of the gas chamber in the receiver $dp_2$—Differential Pressure of the liquid chamber in the receiver g—Gravity $h_3$—Distance between the dp tap at the receiver gas chamber $h_2$—Distance between the dp tap at the receiver liquid chamber $\Delta h_r$—Change in height of the water column in the receiver $x_{rg}$—Steam Quality of the receiver gas chamber $x_{evH}$—Steam Quality after the expansion valve assuming constant enthalpy (h)

$x_{evS}$—Steam Quality after the expansion valve assuming constant entropy (s)

$H_{sev}$—Steam enthalpy after the expansion valve $H_{wev}$—Water enthalpy after the expansion valve $S_{sb}$—Steam entropy at the boiler condition $S_{sev}$—Steam entropy after the expansion valve $S_{wev}$—Water entropy after the expansion valve $A_p$—Vessel crosses area section $dh_b/dt$—Liquid height of the boiler change rate There are a number of power output ( ▭ ), pressure and differential pressure measurement (○), liquid height measurement ( ⓘ ), temperature measurement (○), and flow measurement devices ( ⊘ ), on the source chamber 20 and the receiver chamber 40. The data from these devices contribute to determining the known or measurable parameters of the condensed steam 62, and the confirmed set values of parameters.

Embodiments of the system 10 further include a metering point 70 in the mixing section 52 of the receiver chamber 40. The metering point 70 is exposed to the condensed steam 62 so that any sensor or instrument engaged to the metering point 70 can detect the condensed steam 62. The sensor or instruments are calibrated to the parameters of the condensed steam 62. The precision of the sensor or instrument can now be set, and the sensor or instrument can now be relied upon for measuring steam in another system. FIG. 1 shows the metering point 70 at a top of the receiver chamber 40 or at least near injection means 60, such as near the expansion nozzle 64 of the injection means 60.

In the present invention, the condensed steam has a set value of steam quality in the mixing section 52 of the receiver chamber 40. The equations shows the relationship for how the set value of steam quality in the mixing section 52 of the receiver chamber 40 is determined by two values confirming each other based on parameters of the first steam, second steam, and condensed steam. Confirming includes matching or being within an acceptable amount. At least one parameter of the first steam and the second steam can be adjusted in order for the two values to confirm each other. Those parameters include liquid height level of the source chamber, pressure of the source chamber, density by differential pressure of the source chamber, cloud density by differential pressure of the source chamber, temperature of the source chamber, energy input into the source chamber, liquid height level of the receiver chamber, pressure of the receiver chamber, density by differential pressure of the receiver chamber, cloud density by differential pressure of the receiver chamber, temperature of the receiver chamber, and energy input into the receiver chamber.

In some embodiments, a first value of steam quality is determined by measuring steam density in the mixing section of the receiver chamber, and a second value of steam quality is determined by measuring energy balance and liquid accumulation in the receiver chamber, and in Equations 4 and 18. If there is a difference between the two values, then the system can be adjusted until the values match or are within an acceptable rate of error. Thus, the system has an enhanced precision for the set value of the steam quality, confirmed by different measurements and different processes throughout the system 10. The two values are compared to get a confirmation, and the system can adjust the first steam or the second steam or both in order to establish the set value. The set value of the steam quality is reliable enough to calibrate other sensors and instruments. Furthermore, embodiments of the invention include determining energy balance by measuring reduction of heat in the receiver chamber and liquid accumulation by establishing a set value of mass of steam leaving the source chamber.

When the set value of mass of steam leaving the source chamber is required to confirm the set value of steam quality of the condensed steam, embodiments of the present invention include additional steps. The set value of mass of steam leaving the source chamber can be established similar to the set value of steam quality with two different sets of known or measured parameters, different equations, and different adjustments of the first and second steam. The set value of mass of steam leaving the source chamber will also have the precision and reliability suitable for calibration. A first value of mass of steam is determined by measuring water level in the source chamber, and a second value of mass of steam being determined by measuring power supplied to the source chamber. The first value confirms the second value, wherein the first value matches or is within an acceptable amount of each other. Adjusting at least one parameter of the first steam or the second steam or both can be made until the first value of mass of steam confirms the second value of mass of steam so as to determine the set value of mass of steam leaving the source chamber. The system 10 has enhanced precision of the set value of mass of steam leaving the source chamber, such that the set value of mass can be used to determine the set value of steam quality, which can be reliable enough to calibrate other sensors and instruments.

FIG. 1 also illustrates the method for generating steam for calibration with the system 10. The first steam 30 is generated at a first temperature in a first steam section 24 of a source chamber 20, and a second steam 50 is generated at a second temperature in a second steam section 44 of a receiver chamber 44. The first temperature is greater than the second temperature, so that a condensed steam 62 is formed in the mixing section 52, when the first steam 30 of the higher temperature mixes with the second steam 50. When injecting the first steam 30 from the first steam section into the mixing section 52, the first steam 30 mixes with the second steam 50 so as to form a condensed steam 62 with a set steam quality. The metering point 70 in the mixing section 52 of the receiver chamber 40 is exposed to the condensed steam 62. Sensors or instruments engaged to the metering point 70 can detect the condensed steam 62 and be calibrated with the known parameters of the condensed steam 62. Thus, the sensors or instruments engaged to the metering point 70 are calibrated by the highly precise and reliable set values of the condensed steam.

The step of generating the first steam 30 can further comprise maintaining the first steam 30 in the first steam section 24 with a steam quality of 100%. There can be an additional heating element 32 at a top of the first steam section 24. The source chamber 20 can be insulated and heat traced. The receiver chamber 40 can also be insulated and heat traced. The steam quality can be maintained at 100% in the first steam section 24. The heat of the chambers is maintained for constancy, even with heat loss due to condensation. Embodiments of the method also include recycling fluid back from a fluid outlet 54 of the receiver chamber 40 to the first inlet 26 of source chamber 20. Embodiments of the method include recycling water back from the fluid outlet of the receiver chamber to the first inlet of the source chamber. Also, when the injection means comprises a connecting pipe and a flow meter, the flow rate of the first steam into the mixing section can be measured. This flow rate can determine another known parameter of the condensed steam for the relationship of the adjustments to the first steam and the second steam to generate the condensed steam for calibration.

Embodiments of the method of the present invention include the condensed steam 62 with a known parameter, such as steam quality. Parameters of the first steam, the second steam, and the condensed steam are comprised of a group consisting of: liquid height level of the source chamber, pressure of the source chamber, density by differential pressure of the source chamber, cloud density by differential pressure of the source chamber, temperature of the source chamber, energy input into the source chamber, liquid height level of the receiver chamber, pressure of the receiver chamber, density by differential pressure of the receiver chamber, cloud density by differential pressure of the receiver chamber, temperature of the receiver chamber, and energy input into the receiver chamber. The measurement of at least one of these parameters and determination by equations of the present invention allow adjustment of the system to generate the condensed steam 62 with such reliability and confirmation, such that other sensors and instruments can be calibrated according to the condensed steam. The prior art steam calibration loops and cycles of superheating and condensing for a condensed steam of known parameters is no longer needed. The extensive equipment and space requirements for the additional steam calibration loops and energy demands are also avoided.

For steam quality in the mixing section of the receiver chamber, the set value of steam quality includes the steps of determining a first value of steam quality in the mixing section of the receiver chamber by measuring steam density in the mixing section of the receiver chamber; determining a second value of steam quality in the mixing section of the receiver chamber by measuring energy balance and liquid accumulation in the receiver chamber; and adjusting at least one parameter the first steam and the second steam until the first value of steam quality confirms the second value of steam quality. The confirmed value becomes the set value of steam quality in the mixing section of the receiver chamber. The first and second values confirm that the set value is accurate by measurement of different parameters. Reaching the same value shows adjustment for errors, such as condensation effects. The confirmed value is more accurate and precise, and supported by different measurements and different determinations by equations. Equations, such as Equations 4 and 18 and the measurement of the parameters, support the method of the present invention.

The second value of steam quality requires additional information. In some embodiments, measuring reduction of heat in the receiver chamber determines energy balance in the receiver chamber, which can be used to determine the second value. Furthermore, the second value of steam quality requires liquid accumulation in the receiver chamber, which can be determined by establishing a set value of mass of steam leaving the source chamber. The set value of mass of steam leaving the source chamber can also have increased reliability and accuracy. In the present invention, the method can include determining a first value of mass of steam leaving the source chamber by measuring water level in the source chamber, determining a second value of mass of steam leaving the source chamber by measuring power supplied to the source chamber and adjusting at least one parameter of the first steam and the second steam until the first value of mass of steam confirms the second value of mass of steam. The confirmed value is the set value of mass of steam leaving the receiving chamber. The set value of mass of steam leaving the receiving chamber is now determined by different measurements and different equations. The set value of mass of steam leaving the source chamber is more reliable and accurate to be used to determine the second value of steam quality. In turn, the set value of mass of steam leaving the source chamber is used to confirm the set value of steam quality of the condensed steam in the mixing section.

The present invention calibrates sensors and instruments with steam generated from a steam boiler or steam calibration loop. The calibration is done with condensed steam from the dual chamber system of the present invention. The system and method generates a condensed steam with a known parameter, such as steam quality. The set value of steam quality is reliable and supported by measurement of other parameters of the first steam, the second steam, and the condensed steam and by other calculations based on other parameters of the first steam, the second steam, and the condensed steam. The system and method adjusts until a set value is confirmed by matching or being at least within an acceptable amount or range of error. The present invention can correct and adjust to reduce errors in the set value of steam quality and the set value of mass leaving the source chamber for more reliable steam quality at the metering point. The prior art systems and methods accept the errors due to the steam generation process without any chance or mechanism for correction. The condensed steam has known parameters, which can be measured directly, like in the prior art. However, the known parameters, such as steam quality, of the present invention are also confirmed and supported by independent measurements of the first steam and the second steam. Additionally, the system and method adjust the first steam and the second steam to make the confirmation. The sensors and instruments detect the condensed steam and use these values to calibrate themselves. The sensors and instruments are later used in other processes, such as industrial process or an enhanced oil recovery process, when assessment of a steam is required.

The foregoing disclosure and description of the invention is illustrative and explanatory thereof. Various changes in the details of the illustrated structures, construction and method can be made without departing from the true spirit of the invention.

We claim:

1. A system for generating steam for calibration, comprising:

a source chamber, being comprised of a first heating element, a first steam section, first inlet, and first outlet and generating a first steam at a first temperature in said first steam section;

a receiver chamber, being comprised of a second heating element, a second steam section, a second inlet, and a second outlet, and generating a second steam at a second temperature in said second steam section, wherein said first temperature is greater than said second temperature, and wherein said second steam section has a mixing section;

an injection means between said first steam section and said mixing section, wherein said first steam mixes with said second steam in said mixing section so as to form a condensed steam; and a metering point in said mixing section of said receiver chamber, said metering point being exposed to said condensed steam, wherein said condensed steam has a set value of steam quality in said mixing section of said receiver chamber, wherein parameters of said first steam, said second steam, and said condensed steam are comprised of a group consisting of: liquid height level of said source chamber, pressure of said source chamber, density by differential pressure of said source chamber, cloud density by differential pressure of said source chamber, temperature of said source chamber, energy input into said source chamber, liquid height level of said receiver chamber, pressure of said receiver chamber, density by differential pressure of said receiver chamber, cloud density by differential pressure of said receiver chamber, temperature of said receiver chamber, and energy input into said receiver chamber, and wherein said set value of steam quality in said mixing section of said receiver chamber is determined by adjusting at least one parameter of said first steam and said second steam until a first value of steam quality confirms a second value of steam quality, said first value of steam quality being determined by measuring steam density in said mixing section of said receiver chamber, said second value of steam quality being determined by measuring energy balance and liquid accumulation in said receiver chamber.

2. The system for generating steam, according to claim 1, wherein said energy balance is determined by measuring reduction of heat in said receiver chamber.

3. The system for generating steam, according to claim 1, wherein said liquid accumulation is determined by establishing a set value of mass of steam leaving said source chamber.

4. The system for generating steam, according to claim 3, wherein said set value of mass of steam leaving said source chamber is determined by adjusting at least one parameter of said first steam and said second steam until a first value of mass of steam confirms a second value of mass of steam, said first value of mass of steam being determined by measuring water level in said source chamber, said second value of mass of steam being determined by measuring power supplied to said source chamber.

5. The system for generating steam, according to claim 1, further comprising:

a sensor engaged to said metering point, said sensor detecting said condensed steam, said sensor being calibrated to said set value of steam quality.

6. The system for generating steam, according to claim 1, said source chamber being further comprised of an additional heating element at a top of said first steam section.

7. The system for generating steam, according to claim 1, wherein said source chamber is insulated and heat traced, and wherein said receiver chamber is insulated and heat traced.

8. The system for generating steam, according to claim 1, wherein said first steam is maintained with a steam quality of 100%.

9. The system for generating steam, according to claim 1, wherein said receiver chamber has a fluid outlet in fluid connection with said first inlet of said source chamber, and wherein water recycles back from said fluid outlet of said receiver chamber to said first inlet of source chamber.

10. The system for generating steam, according to claim 1, wherein said injection means comprises a connecting pipe and a flow meter, said flow meter measuring flow rate of said first steam into said mixing section.

* * * * *